United States Patent [19]

Imanaka et al.

[11] Patent Number: 4,804,609

[45] Date of Patent: Feb. 14, 1989

[54] DEVELOPING AGENT FOR ELECTROPHOTOGRAPHY WITH SILICA AND MAGNETITE ADDITIVES

[75] Inventors: Yoshiaki Imanaka; Hideaki Taniguchi, both of Nara, Japan

[73] Assignee: Sharp Kabushiki Kaisha, Osaka, Japan

[21] Appl. No.: 43,699

[22] Filed: Apr. 29, 1987

[30] Foreign Application Priority Data

May 1, 1986 [JP] Japan ..... 61-101429

[51] Int. Cl.[4] ..... G03G 9/14; G03G /9/08

[52] U.S. Cl. ..... 430/106.6; 430/110

[58] Field of Search ..... 430/106.6, 110

[56] References Cited

U.S. PATENT DOCUMENTS

| | | | |
|---|---|---|---|
| 3,345,294 | 10/1967 | Cooper | 430/106.6 X |
| 3,720,617 | 3/1973 | Chatterji et al. | 430/110 |
| 4,336,318 | 6/1982 | Fukumoto et al. | 430/110 X |
| 4,414,322 | 11/1983 | Miyakawa et al. | 430/108 X |
| 4,482,621 | 11/1984 | Kashiwagi | 430/108 X |
| 4,585,723 | 4/1986 | Kishi et al. | 430/106.6 X |
| 4,652,509 | 3/1987 | Shirose et al. | 430/106.6 X |

FOREIGN PATENT DOCUMENTS

| | | | |
|---|---|---|---|
| 59-223451 | 12/1984 | Japan | 430/106.6 |

*Primary Examiner*—Roland E. Martin

*Attorney, Agent, or Firm*—Flehr, Hohbach, Test, Albritton & Herbert

[57] ABSTRACT

A developing agent for electrophotographic copier contains $SiO_2$ and/or magnetite in addition to a toner such that talc can be effectively removed from the photoreceptor surface.

3 Claims, 2 Drawing Sheets

DEVELOPING AGENT FOR ELECTROPHOTOGRAPHY WITH SILICA AND MAGNETITE ADDITIVES

BACKGROUND OF THE INVENTION

This invention relates to a developing agent for an electrophotographic copier and more particularly to such a developing agent capable of removing talc which becomes attached to the surface of the photoreceptor.

By way of introduction, processes generally carried out inside an electrophotographic copier are explained first with reference to FIG. 5 wherein a primary charger 1, a development device 2, a transfer charger 4, a paper removal charger 5, a cleaner 6 and an erasing charger 7 are shown around the periphery of a photoreceptor drum 8. The primary charger 1 is for negatively charging the surface of the photoreceptor drum 8. The development device 2 serves to apply a developing agent on the exposed surface of the photoreceptor drum 8 so as to form a visible image from a latent image which was formed by incident light on the negatively charged surface of the photoreceptor drum 8 by means of an optical system (not shown).

In synchronism with the rotation of the photoreceptor drum 8 in the direction of the arrow A, a copy paper sheet is introduced in the direction of the arrow B. This sheet is brought to the image transfer position C by means of a paper guide 3. The transfer charger 4 discharges electric charges of polarity opposite to that of the developing agent when the copy paper sheet passes between the surface of the photoreceptor drum 8 and itself. This discharge causes the developing agent, which has been electrostatically attached to the surface of the photoreceptor drum 8, to move onto the surface of the copy paper sheet.

The paper removal charger 5 provides an AC corona discharge or the like to the copy paper sheet after the image transfer process, thereby weakening the force with which the copy paper sheet is attached to the surface of the photoreceptor drum 8. The cleaner 6 removes and collects the residual developing agent remaining on the surface of the photoreceptor drum 8 by pressing thereonto a cleaning blade or the like. Thereafter, the erasing charger 7 erases the residual charges on the surface of the photoreceptor drum 8 or makes them uniform before it is charged again.

Image receiving media such as copy paper sheets generally contain talc with magnesium silicate or the like as its principal component so as to make their surface smooth or as a filler which prevents ink or the like from spreading. Such talc is easily separated from the paper, and it has strong affinity with organic substances. For this reason, talc particles falling off from copy paper sheets become attached to the surface of the photoreceptor drum by the discharge of the transfer charger. This happens more prominently if the surface of the photoreceptor drum is made of an organic material. Although the surface of the photoreceptor drum is cleaned by a cleaning blade or the like after each transfer process, talc particles, being smaller than the particles of the developing agent, cannot be removed easily especially if the affinity of the surface of the photoreceptor drum is strong.

In summary, talc particles remain on the surface of the photoreceptor drum even after a cleaning process. In the next cycle of the copier operation, such talc particles remaining on the surface of the photoreceptor drum become charged in polarity opposite to the developing agent such that a potential difference results between where talc is attached and where it is not attached, areas where talc is attached attracting the developing agent. Particles of the developing agent thus adsorbed where talc is attached become transferred onto the surface of copy paper sheet at the time of next transfer, producing black dots and black lines and generally affecting the quality of the toner image adversely. Attempts have therefore been made to redesign the paper transfer route or the angle of contact between the incoming paper and the photoreceptor drum but there have been no basic solutions to this problem by mechanical improvements.

SUMMARY OF THE INVENTION

It is therefore an object of the present invention to provide a developing agent for an electrophotographic copier which, having the required characteristics of a developing agent, is also capable of removing talc from copy paper sheets attached to the surface of the photosensitive body, thereby preventing ill-effects of such talc on toner images.

The above and other objects of the present invention are achieved by adding $SiO_2$ and/or magnetite to a developing agent for electrophotographic copiers.

According to experiments, developing agents of the present invention have their characteristics as developing agent unaffected and can remove talc from copy paper sheets attached to the surface of a photosensitive body. Ill-effects of talc on the quality of toner images can thus be prevented. Purposes and advantages of using developing agents of the present invention will become apparent from the detailed description of the present invention given below by way of graphs.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

A developing agent of the present invention may be of a two-component type of the well-known kind having a toner and a carrier as its principal components or of a one-component type having a carrier-less toner as the principal component and additionally contains 0.05–0.50 wt % of $SiO_2$ and 0.05–0.50 wt % of magnetite with respect to the weight of toner in the developing agent such that the total weight of $SiO_2$ and magnetite is at least 0.30% of the weight of the toner. $SiO_2$ is in the form of hydrophobic silica of particle size of about 10–30 mμ and magnetite is in the form of cubic magnetic oxide of iron of average particle diameter of about 0.50 μ.

Figure 1:
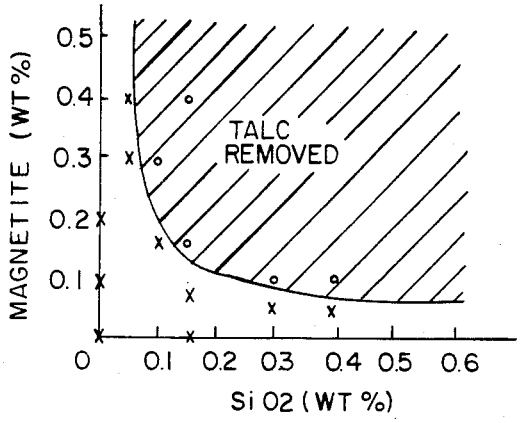
FIG. 1 is a graph showing the talc-removing characteristics of developing agents embodying the present invention.
Figure 3:
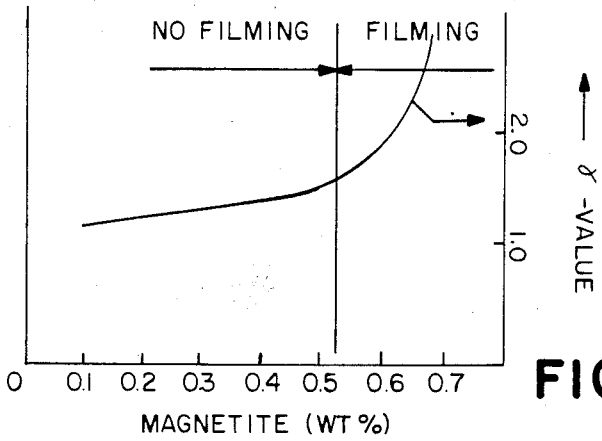
FIG. 3 is a graph showing the changes in the image quality and the filming phenomenon as the added amount of magnetite is varied.
Figure 4:
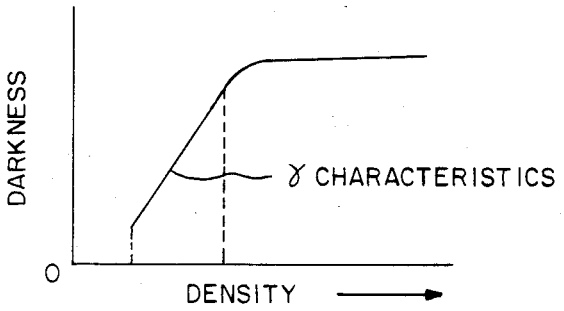
FIG. 4 is a graph showing the relationship between the darkness of the print and the density of the original document which is copied.
Figure 5:
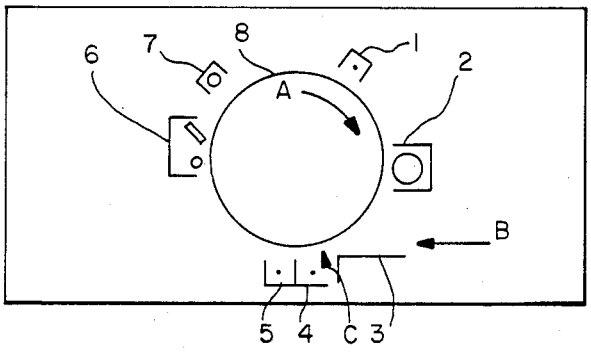
FIG. 5 is a schematic front view of a principal processing section of an electrophotographic copier which can use a developing agent of the present invention.

For the series of tests, the results of which are shown in FIGS. 1 through 4, standard postcards as copy paper sheets with relatively high talc concentration and two-component developing agents containing $SiO_2$ and magnetite at various rates were prepared and, after 500 postcards were continuously run through an ordinary copier with a processing section shown in FIG. 5 by using one of the prepared developing agents at a time, traces of talc appearing on white areas corresponding to a specified level of exposure were analyzed. FIG. 1 shows that talc is effectively removed even if the developing agent contains as little as 0.05 wt %, which is the minimum requirement according to the present invention, or if the developing agent contains only 0.05 wt % of magnetite but no $SiO_2$.

Figure 2:
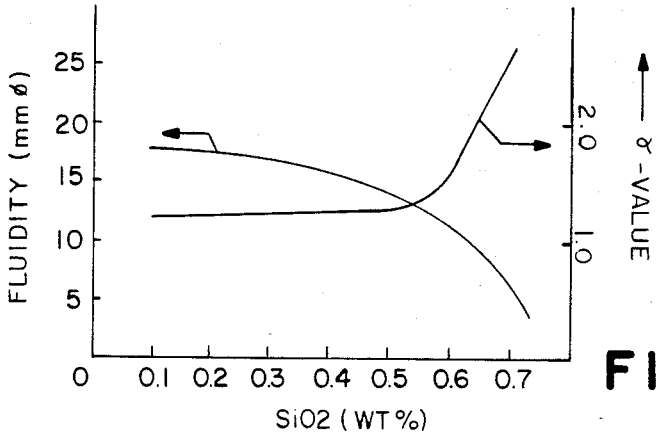
FIG. 2 is a graph showing the changes in the image quality and the fluidity of developing agent as the added amount of $SiO_2$ is varied.

$SiO_2$ and magnetite should not be added excessively, however, as can be.understood by viewing FIGS. 2 and 3. If the $SiO_2$ concentration exceeds 0.50 wt %, image hardness (or the γ-value) increases and the fluidity of the developing agent drops as shown in FIG. 2. Likewise, if the magnetite concentration exceeds 0.50 wt %, image hardness (or the γ-value) increases and problem of filming phenomenon occurs on the surface of the photoreceptor drum as shown in FIG. 3. From the experimental results depicted in FIGS. 1, 2 and 3, therefore, it is concluded that the $SiO_2$ concentration and the magnetite concentration should be both in the range between 0.05 and 0.50 wt % and their sum should be 0.30 wt % or greater with respect to the weight of the toner. FIG. 4 is a graph showing how the aforementioned γ-value is defined. In a graph showing the relationship between the darkness of a print and the density of the original document from which the print was made, there is a region in which the characteristic curve has a rising section and the γ-value is defined as the slope of this rising curve.

What is claimed is:

1. In a developing agent for electrophotographic copier comprising toner, the improvement wherein said developing agent includes $SiO_2$ and magnetite externally added to said toner, the amount of $SiO_2$ in said developing agent is 0.05–0.50 wt % with respect to said toner, the amount of said magnetite in said developing agent is 0.05–0.50 wt % with respect to said toner, and the total amount of $SiO_2$ and magnetite in said developing agent is at least 0.3 wt % up to about 1.0 wt % with respect to said toner wherein said magnetite is of average particle diameter of about 0.50.

2. The developing agent of claim 1 wherein said developing agent contains $SiO_2$ in the form of hydrophobic silica of particle size of about 10–50 mμ.

3. The developing agent of claim 1 wherein said developing agent contains magnetite in the form of cubic magnetic oxide of iron of average particle diameter about 0.50 μ.

* * * * *